US007938687B2

(12) United States Patent
Zhu

(10) Patent No.: US 7,938,687 B2
(45) Date of Patent: May 10, 2011

(54) COMPACT STACKED CARD EDGE CONNECTOR ASSEMBLY

(75) Inventor: Jian-Kuang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/717,962

(22) Filed: Mar. 5, 2010

(65) Prior Publication Data

US 2010/0227508 A1 Sep. 9, 2010

(30) Foreign Application Priority Data

Mar. 5, 2009 (CN) ..... 2009 2 0301094

(51) Int. Cl.
*H01R 24/00* (2006.01)

(52) U.S. Cl. ..... 439/631

(58) Field of Classification Search ..... 439/631–637, 439/541.5, 79, 326–328
See application file for complete search history.

(56) References Cited

U.S. PATENT DOCUMENTS

| | | | | |
|---|---|---|---|---|
| 5,755,585 | A * | 5/1998 | Cheng et al. | 439/326 |
| 6,126,472 | A | 10/2000 | Choy | |
| 6,176,737 | B1 * | 1/2001 | Choy | 439/541.5 |
| 6,506,074 | B2 * | 1/2003 | Hashimoto | 439/541.5 |
| 7,273,381 | B2 * | 9/2007 | Ito | 439/79 |

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

A card edge connector assembly for connecting a pair of electrical cards to a printed circuit board includes an upper connector and a lower connector. The upper connector includes a first insulative housing with a plurality of first terminals mounted therein. The first insulative housing defines a recess thereunder and extending from a first front face of the first insulative housing thereof. The lower connector includes a second insulative housing with a plurality of second terminals mounted therein and received in said recess under the upper connector. The second insulative housing defines a second front face which is in alignment with the first front face in a vertical direction.

20 Claims, 7 Drawing Sheets

COMPACT STACKED CARD EDGE CONNECTOR ASSEMBLY

BACKGROUND OF THE INVENTION

1. Field of the Invention

The present invention relates to a card edge connector assembly, and more particularly to a compact card edge connector assembly configured a first connector with a second connector integrally assembled under the first connector.

2. Description of the Related Art

U.S. Pat. No. 6,126,472 issued to Choy on Oct. 3, 2000 discloses a connector assembly including a lower housing and an upper housing each generally including the basic structure of the typical SO DIMM connector housing. Each housing defines two rows of passageways on two sides of the central slot in which the corresponding module is received. A plurality of contacts are received within the corresponding passageways wherein the tail of each contact extends downward to engage the corresponding circuit on the PC board on which the connector assembly is mounted. The upper housing includes a standoff portion thereabouts wherein the standoff's thickness is generally equal to the thickness of the lower housing so that the upper housing defines a space thereunder to have the lower housing positioned therein under the condition that the upper housing and the lower housing are substantially offset with each other in the front-to-end direction.

As the lower housing and the upper housing are configured in an offset manner in the front-to-end direction, the connector assembly takes up a significant amount of space. Obviously, an improved card edge connector assembly is highly desired to overcome the aforementioned problem.

SUMMARY OF THE INVENTION

Accordingly, an object of the present invention is to provide a card edge connector assembly with compact configuration.

In order to achieve the object set forth, a card edge connector assembly for connecting a pair of electrical cards to a printed circuit board includes an upper connector and a lower connector. The upper connector includes a first insulative housing with a plurality of first terminals mounted therein. The first insulative housing defines a recess thereunder and extending from a first front face of the first insulative housing thereof. The lower connector includes a second insulative housing with a plurality of second terminals mounted therein and received in said recess under the upper connector. The second insulative housing defines a second front face which is in alignment with the first front face in a vertical direction.

Other objects, advantages and novel features of the invention will become more apparent from the following detailed description of the present embodiment when taken in conjunction with the accompanying drawings.

DETAILED DESCRIPTION OF THE INVENTION

Figure 1:
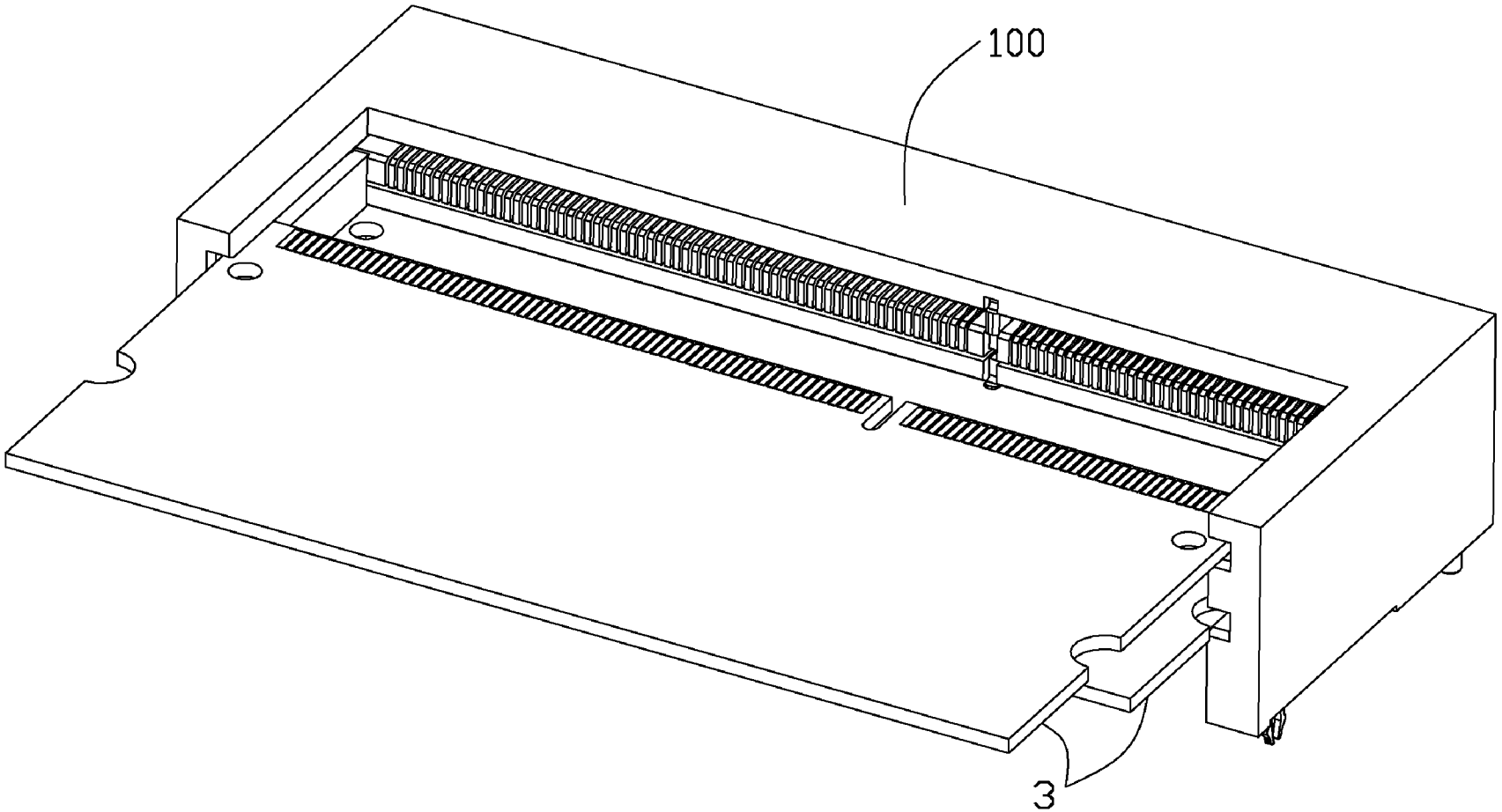
FIG. 1 is a perspective view of a card edge connector assembly in accordance with the present invention, in which a pair of memory modules are mounted therein.
Figure 2:
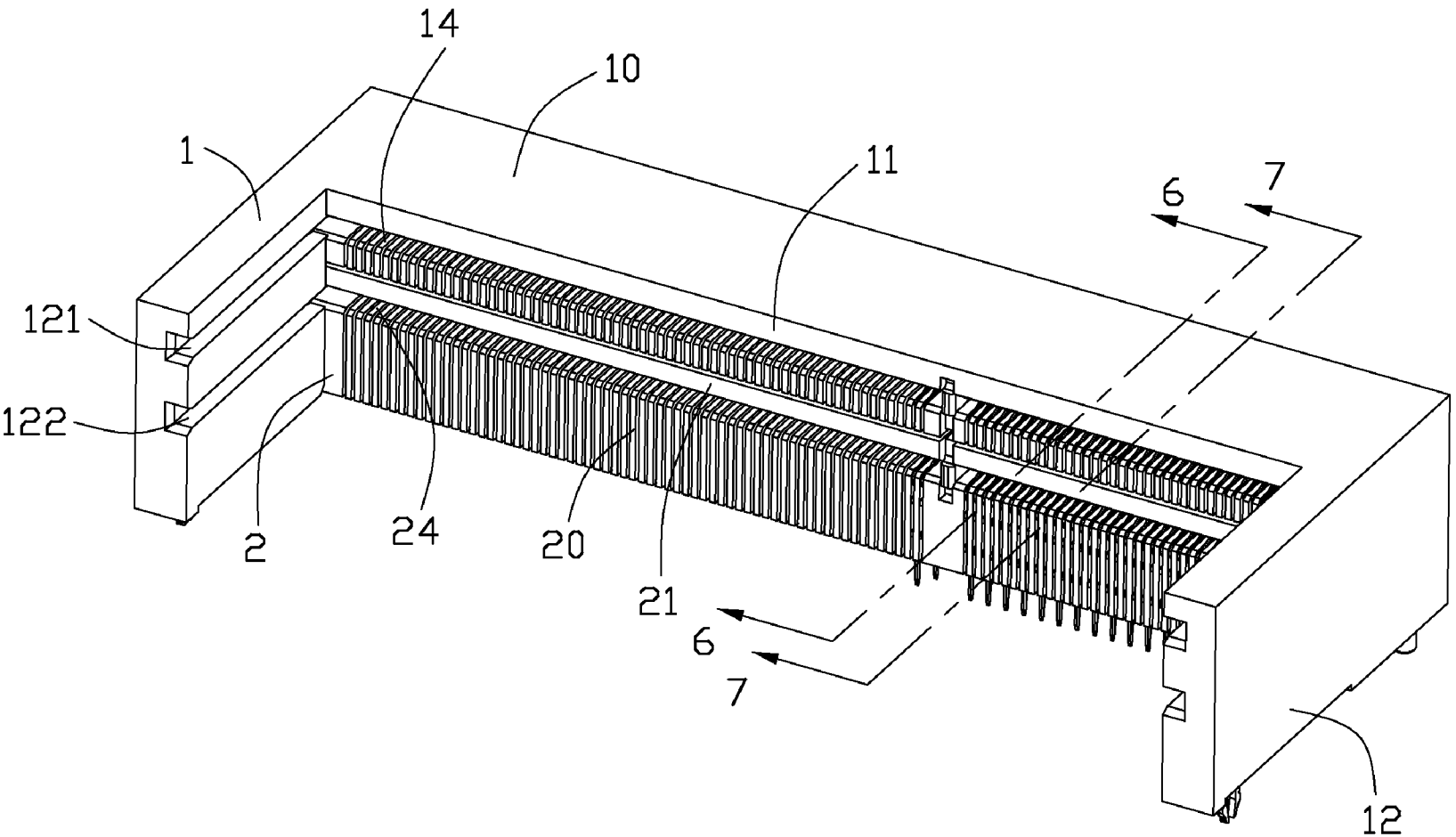
FIG. 2 is a perspective view of the card edge connector assembly shown in FIG. 1.

Reference will now be made to the drawing figures to describe a preferred embodiment of the present invention in detail. Referring to FIGS. 1 and 2, a card edge connector assembly 100 according to the preferred embodiment of the present invention is provided and comprises an upper connector 1 and a lower connector 2 for respectively connecting a pair of memory modules 3 to a printed circuit board (not shown).

The upper connector 1 and the lower connector 2 respectively include an elongated insulative housing 10, each defines a front face 11, 21 in a front end thereof and a receiving cavity 14, 24 expanding along a transverse direction and running through the front face 11, 21. The insulative housing 10 forms a pair of guiding arms 12 at opposite ends thereof and perpendicularly extending forward from said insulative housing 10. A pair of guiding passageways 121, 122 parallel to each other are defined at an inner side of each guiding arm 12. The guiding passageways 121, 122 together with the corresponding receiving cavities 14, 24 are respectively located at a same plane thereof and each guiding passageway 121, 122 is in communication with the corresponding receiving cavities 14, 24, therefore the memory modules 3 can be inserted into the receiving cavities 14, 24 in a horizontal manner through the guiding passageways 121, 122. After the memory modules 3 are received within the receiving cavities 14, 24, edges of the memory modules 3 are interfering with inner faces of the guiding passageways 121, 122 thereby introducing a maintaining force for securing the memory modules 3 therein.

Figure 3:
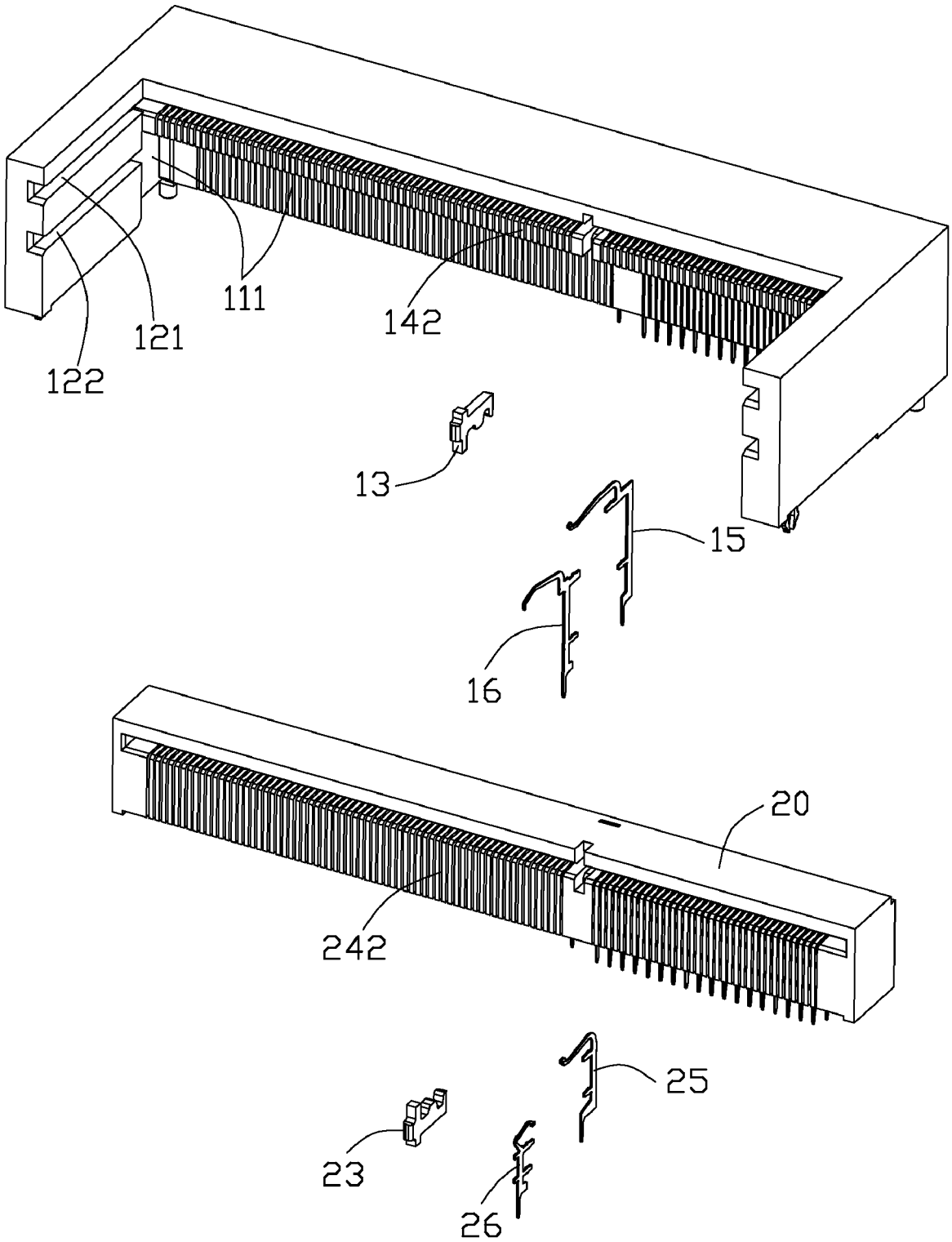
FIG. 3 is an exploded perspective view of the card edge connector assembly shown in FIG. 2.
Figure 4:
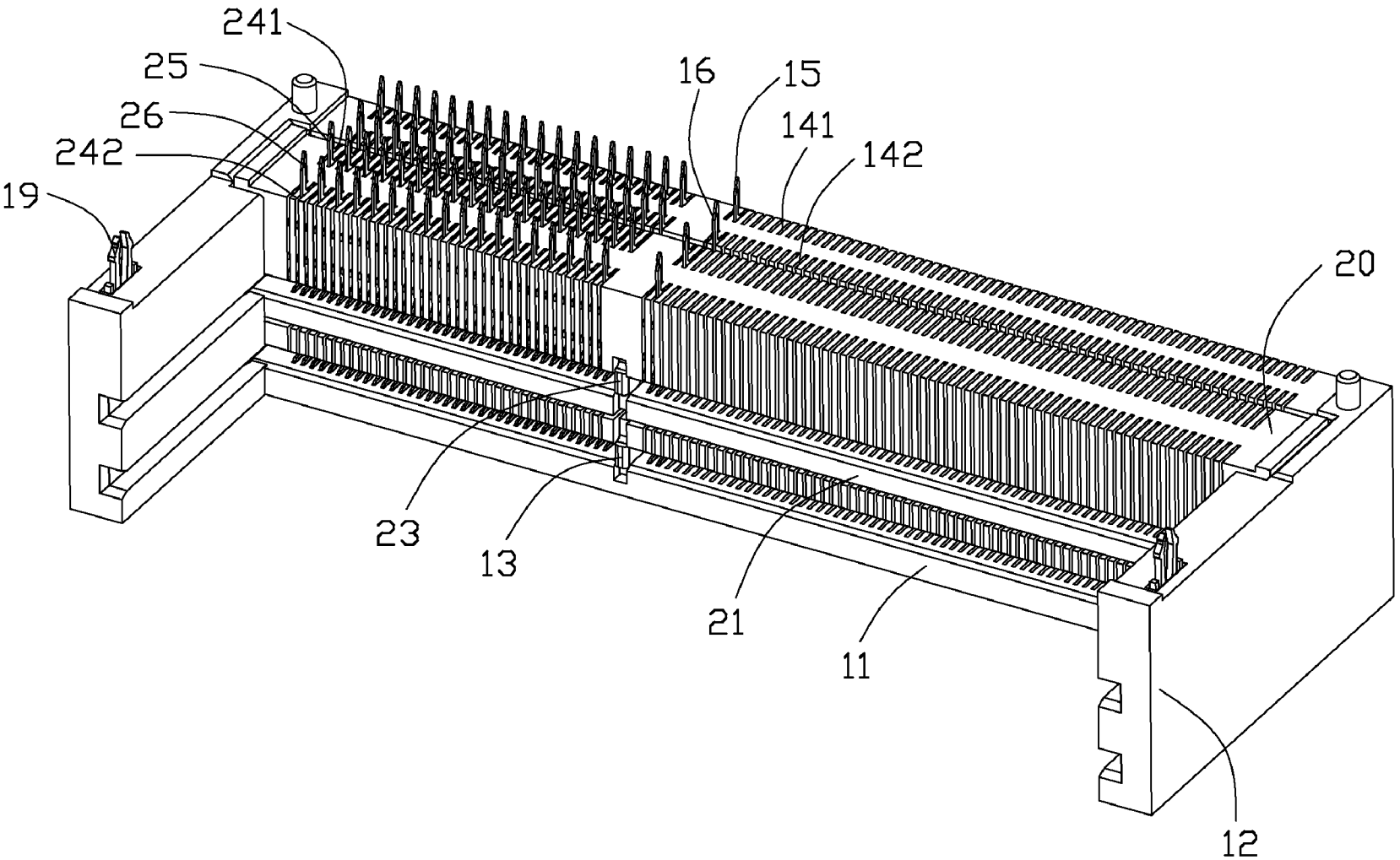
FIG. 4 is another perspective view of the card edge connector assembly shown in FIG. 2.
Figure 5:
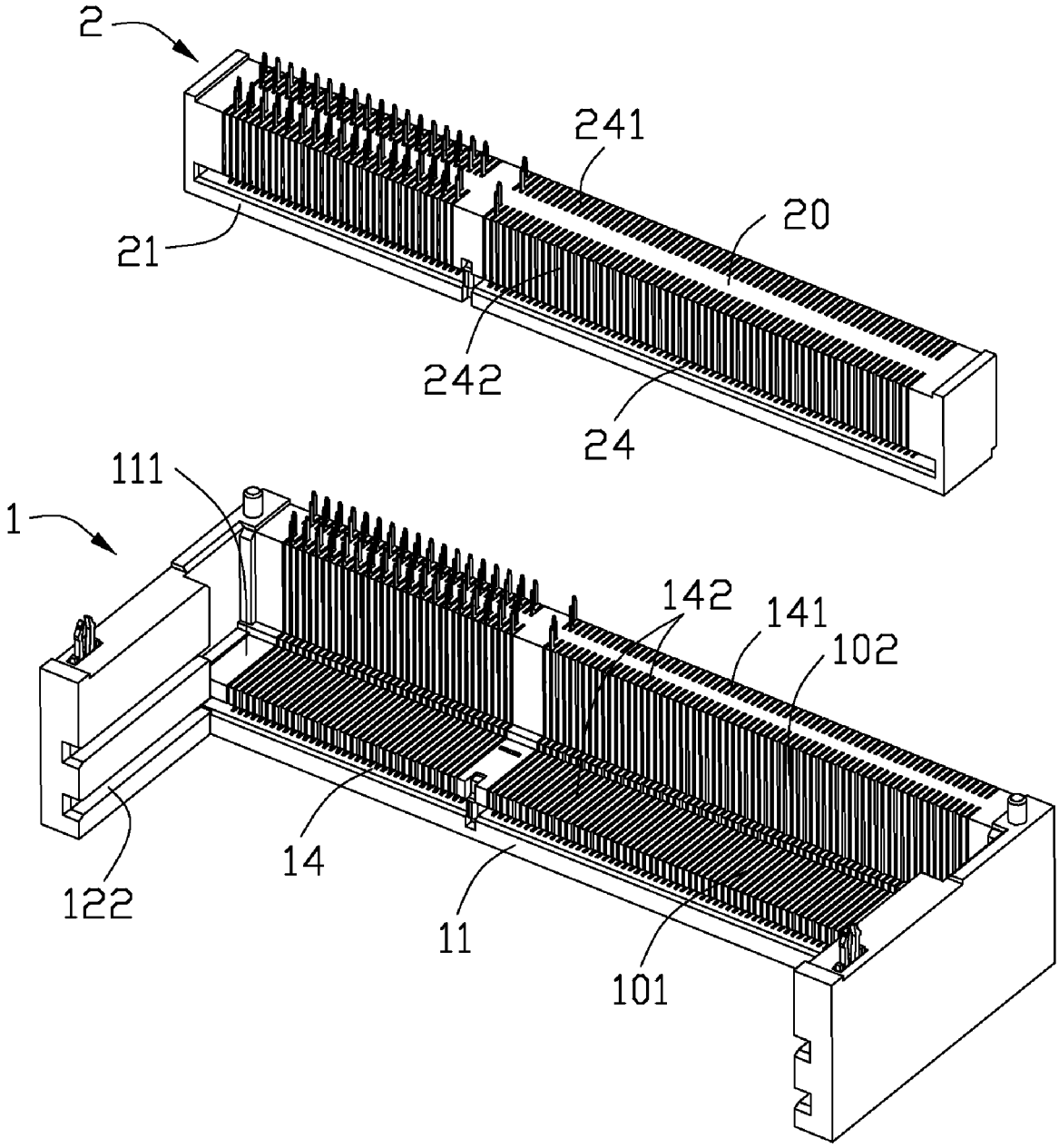
FIG. 5 is a partly exploded perspective view of the card edge connector assembly shown in FIG. 4.

Referring to FIG. 3 to FIG. 5, the insulative housing 10 of the upper connector 1 defines a recess 111 extending backward from the front face 11 thereby making the insulative housing 10 in a L-shaped configuration. The recess 111 is defined at rear ends of the guiding arms 12 and in communication with the lower guiding passageways 122. The rear ends of the guiding arms 12 are cut out partly to commonly form the recess 111, therefore the length of the recess 111 in the transverse direction is longer than the distance between the lower guiding passageways 122. The insulative housing 20 of the lower connector 2 is also in an elongated shape and configured without guiding arms. The insulative housing 20 is inserted into the recess 111 from the bottom face of the insulative housing 10 until the receiving cavity 24 is in align with the lower guiding passageways 122. The insulative housing 20 takes up the whole space of the recess 111 and the front face 21 of the insulative housing 20 is in align with the front face 11 of the insulative housing 10 in a vertical direction thereby the two insulative housings 10, 20 forming a compact insulative housing, which is helpful for the miniaturization trend of the card edge connector assembly.

A plurality of upper and lower terminal grooves 141, 142 are defined at opposite sides of the receiving cavity 14 and arranged along the transverse direction. The lower terminal grooves 142 runs through a top wall 101 and a rear wall 102 of the recess 111. The first upper terminal group 15 inserts into the upper terminal groove 141 along a rear-to-front direction, while the first lower terminal group 16 inserts into the lower terminal groove 142 along a front-to-rear direction. A plurality of upper and lower terminal grooves 241, 242 are also defined at opposite sides of the receiving cavity 24 of the lower connector 2, the second upper terminal group 25 and the second lower terminal group 26 are respectively inserted into the upper and lower terminal grooves 241, 242.

A pair of metallic keys 13, 23 are respectively received in the mating cavities 14, 24 for inserting into corresponding gaps defined in a mating edge of the memory module 3. The keys 13, 23 are made from metal material for increasing the reliability of the key. A pair of board locks 19 are inserted into a front end of the guiding arm 12 from a bottom side for providing an anchoring force between the card edge connector assembly 100 and the PCB.

Figure 6:
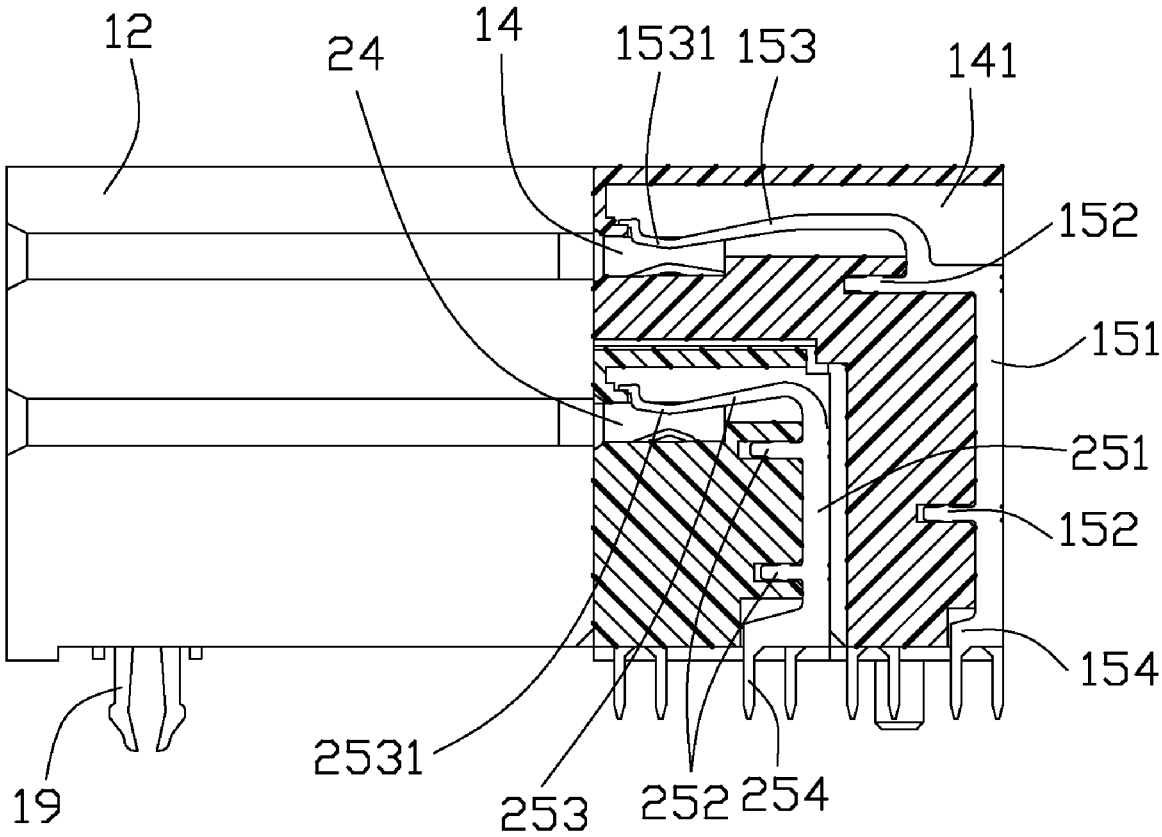
FIG. 6 is a cross-sectional view of the card edge connector assembly shown in FIG. 2 along line 6-6.
Figure 7:
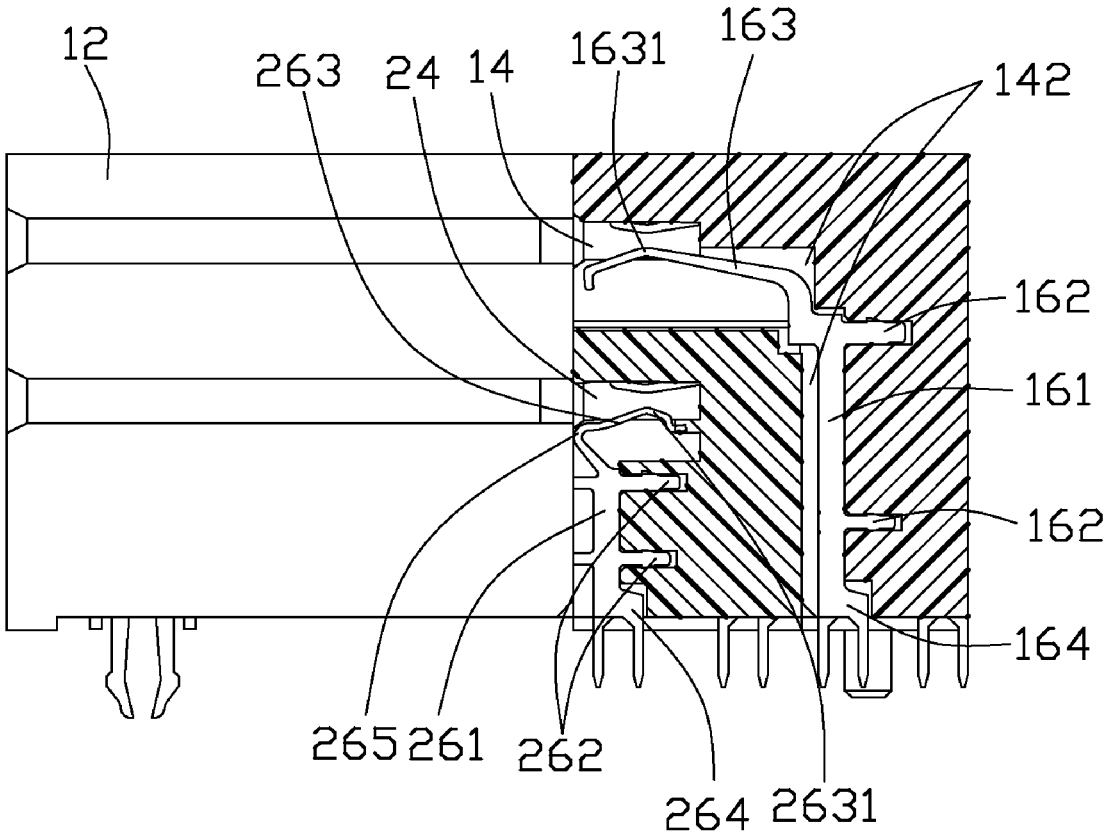
FIG. 7 is a cross-sectional view of the card edge connector assembly shown in FIG. 2 along line 7-7.

Referring to FIGS. 6 and 7, the first and second upper terminal groups 15, 25 are respectively inserted into the corresponding terminal grooves and the basic structure of each terminal is nearly the same, which comprises an elongated body portion 151/251, a pair of retaining arms 152/252 perpendicularly extending from upper and lower portions of the body portion 151/251, a contact arm 153/253 extending forward from a top edge of the body portion 151/251, and a tail portion 154/254 extending downward from a bottom edge of the body portion. The contact arm 153/253 extends forward with a curved contacting portion 1531/2531 protruding downwardly to contact with conductive pad formed on the memory module and a distal end extending upward to abut against the insulative housing.

The first and second lower terminal groups 16, 26 are respectively inserted into the insulative housing 10, 20 from the front face 11, 21 thereof. The second lower terminal group includes a plurality of second lower terminals 26, each comprises an elongated body portion 261, retaining arms 262 perpendicularly extending rearward from the body portion 261 and fixed in the insulative housing 20, a solder portion 264 extending downward from the lower edge of body portion 261, and a contacting arm 263 extending from the upper edge of the body portion 261. The portion between the contacting arm 263 and the body portion 261 is configured as a connecting portion 265, which slantwise extends forwardly and upwardly firstly and then backwardly thereby providing a preferable flexibility for the contacting arm 263. The contacting arm 263 also forms a curved contacting portion 2631 projecting into the receiving cavity 24 which is in align with the contacting portion 2531 of the second upper terminal 25, therefore both the contacting portions 2531, 2631 can provide a steadily interfering force when the memory module 3 is inserted into the receiving cavity 24 in a horizontal manner. In addition, the retaining arms 262 and the contacting arm 263 are located at a same side of the body portion 261.

The first lower terminal 16 comprises an elongated body portion 161, retaining arms 162 perpendicularly extending backward from the body portion 161, a solder portion 164 extending downward from a lower edge of the body portion 161 and a contacting arm 163 forward extending from the body portion 161. The contacting arm 163 forms a contact portion 1631 extending downward from the contacting arm and is in align with the contact portion 1531 of the first upper terminal 15 in the vertical direction, both the contacting portions 1531, 1631 can provide a steadily interfering force when the memory module 3 is inserted into the receiving cavity 14 in a horizontal manner. Additionally, the contacting arm 163 and the retaining arms 162 are located at opposite sides of the body portion 161. The insulative housing 20 is located in front of the body portion 161 of the first lower terminal 16, which can prevent the first lower terminal 16 releasing from the insulative housing 10.

The contacting arm 163 of the first lower terminal 16 is much longer than the contacting arm 263 of the second lower terminal 26, that is because the insulative housing 20 is received in the recess 111 under the upper connector 1 and both the upper and lower connectors 1, 2 are arranged in a vertical alignment manner. Under this condition, the first lower terminal 16 can not form the connecting portion 265 as the second lower terminal 26, which is helpful for ensuring the intensity of the first lower terminal 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector assembly for connecting a pair of electrical cards to a printed circuit board comprising:

an upper connector, comprising a first insulative housing defining a first central slot therein and extending along a longitudinal direction for receiving a first card therein, and a plurality of first terminals mounted in the first insulative housing, a recess being defined under the first insulative housing; and a lower connector, comprising a second insulative housing defining a second central slot therein and extending along the longitudinal direction for receiving a second card therein, and a plurality of second terminals mounted in the second insulative housing, the lower connector being received in said recess under the upper connector;

wherein the second insulative housing defines a second front face in front of the second central slot, and the first insulative housing defines a first front face in front of the first central slot under condition that the second front face is in alignment with the first front face in a vertical direction which is perpendicular to the longitudinal direction.

2. The card edge connector assembly as described in claim 1, wherein the first insulative housing defines a pair of arms located at opposite ends thereof, while the second insulative housing has no arms.

3. The card edge connector assembly as described in claim 2, wherein each arm of the first insulative housing defines a pair of guiding passageways at an inner side thereof which are respectively in communication with the first and second central slots of the first and second insulative housing.

4. The card edge connector assembly as described in claim 3, wherein the second insulative housing is inserted into the recess through a bottom face of the first insulative housing and sandwiched between the pair of arms.

5. The card edge connector assembly as described in claim 1, wherein the first terminals comprise at least one first upper terminal and first lower terminal, the second terminals comprise at least one second upper terminal and second lower terminal, the first and second upper terminals are inserted into the corresponding insulative housing along a rear-to-front direction, while the first and second lower terminals are inserted into the corresponding inculative housing along a front-to-rear direction.

6. The card edge connector assembly as described in claim 5, wherein the first and second lower terminals respectively comprise an elongated body portion extending along the vertical direction, a contacting arm and at least one retaining arm extending from the body portion, the second insulative housing is located in front of the body portion of the first lower terminal.

7. The card edge connector assembly as described in claim 6, wherein the contacting arm and the at least one retaining arm of the second lower terminal are located at a same side of the second lower terminal, while the contacting arm and the at least one retaining arm of the first lower terminal are located at an opposite sides of the first lower terminal.

8. The card edge connector assembly as described in claim 7, wherein the contacting arm of the first lower terminal is longer the contacting arm of the second lower terminal, and the contacting arms of the first and second lower terminals extend along opposite directions.

9. A card edge connector assembly, comprising:

a first connector comprising a first housing defining a first mating cavity therein extending along a longitudinal direction, a pair of arms extending forwardly from longitudinal ends of the first mating cavity, a plurality of first terminals being retained at opposite sides of the first mating cavity, and a first key disposed in the first mating cavity adjacent to one of the arms, a recess being defined in a lower portion of the first housing and commonly defining a first mating face together with the first housing thereof; and a second connector inserted into the recess from a bottom face of the first housing and located within the first mating face, comprising a second housing defining a second mating cavity extending along the longitudinal direction and a plurality of second terminals being retained at opposite sides of the second mating cavity, and a second key disposed in the second mating cavity and being in alignment with the first key in a vertical direction perpendicular to the longitudinal direction.

10. The card edge connector assembly as described in claim 9, wherein the arms are cut out partly adjacent to the first housing to commonly form the recess, the second housing is sandwiched between the arms.

11. The card edge connector assembly as described in claim 9, wherein each arm defines an upper and a lower guiding passageways parallel to each other, the upper passageway extends into the first mating cavity while the lower passageway extends into the recess and in communication with the second mating cavity when the second connector is received in the recess.

12. The card edge connector assembly as described in claim 11, wherein the first terminals comprise at least one first upper terminal and first lower terminal, the second terminals comprise at least one second upper terminal and second lower terminal, the first lower terminal defines a first contacting arm extending forwardly, while the second lower terminal defines a second contacting arm extending rearwardly.

13. The card edge connector assembly as described in claim 12, wherein the first upper terminal and first lower terminal respectively define a contacting portion arranged in a vertical alignment.

14. The card edge connector assembly as described in claim 9, wherein the second connector defines a second mating face in alignment with the first mating face.

15. An electrical connector assembly comprising:

a first connector and a second connector, said first connector including a first insulative housing defining a first elongated receiving slot which defines a longitudinal direction and is equipped with two rows of first contacts by two sides thereof;

said second connector including a second insulative housing defining a second elongated slot with two rows of second contacts by two sides thereof, said first elongated slot and said second elongated slot being parallel to each other, and essentially aligned with each other in a vertical direction perpendicular to said longitudinal direction; and a pair of insulative first guide arms and a pair of insulative second guide arms commonly unitarily extending forwardly from two opposite ends of only one of said first housing and said second housing; wherein the pair of first guide arms define a pair of first guide grooves in alignment with the first receiving slot in a front-to-back direction perpendicular to both said longitudinal direction and said vertical direction; the pair of second guide arms define a pair of second guide grooves in alignment with the second receiving slot in said front-to-back direction.

16. The electrical connector assembly as claimed in claim 15, wherein said pair of first guide arms and said pair of second guide arms are unitarily formed with each other in the vertical direction.

17. The electrical connector assembly as claimed in claim 15, wherein the only one of the first housing and the second housing is the first housing which is located above the second housing.

18. The electrical connector assembly as claimed in claim 17, wherein the first housing defines a recess in a lower portion to protectively receive said second housing therein.

19. The electrical connector assembly as claimed in claim 15, wherein the only one of the first housing and the second housing is the first housing, and the second housing is assembled to the first housing along said vertical direction.

20. The electrical connector assembly as claimed in claim 15, wherein the first housing defines a first bottom which is essentially coplanar with a second bottom face defined by the second housing, said first contacts having corresponding first soldering portions extending downwardly beyond the first bottom face, and said second contacts having corresponding second soldering portions extending downwardly beyond the second bottom face.

* * * * *